US010767842B2

(12) United States Patent
Herft

(10) Patent No.: US 10,767,842 B2
(45) Date of Patent: Sep. 8, 2020

(54) SWIVELING SUPPORT FOR AMENITIES

(71) Applicant: Terence Herft, Rancho Palos Verdes, CA (US)

(72) Inventor: Terence Herft, Rancho Palos Verdes, CA (US)

( * ) Notice: Subject to any disclaimer, the term of this patent is extended or adjusted under 35 U.S.C. 154(b) by 0 days.

(21) Appl. No.: 14/590,785

(22) Filed: Jan. 6, 2015

(65) Prior Publication Data

US 2015/0204460 A1 Jul. 23, 2015

Related U.S. Application Data

(60) Provisional application No. 61/929,629, filed on Jan. 21, 2014.

(51) Int. Cl.

| | |
|---|---|
| ***F21V 21/26*** | (2006.01) |
| ***F21S 19/00*** | (2006.01) |
| ***F21L 27/00*** | (2006.01) |
| ***F23D 14/12*** | (2006.01) |
| *F21S 8/08* | (2006.01) |

(52) U.S. Cl.

CPC ..... *F21V 21/26* (2013.01); *F21L 27/00* (2013.01); *F21S 19/00* (2013.01); *F23D 14/12* (2013.01); *F21S 8/08* (2013.01)

(58) Field of Classification Search

CPC .... F16L 3/01; F16L 3/26; F21V 21/26; F24H 9/06; F21S 19/00; F21S 8/08; F21L 27/00; F23D 14/00; F23D 14/12

See application file for complete search history.

(56) References Cited

U.S. PATENT DOCUMENTS 1,467,303 A * 9/1923 Bezer ..... B61L 29/286 116/63 R
6,222,503 B1 * 4/2001 Gietema ..... H01Q 1/1207 343/700 MS
2005/0270176 A1 * 12/2005 Richardson ..... G09F 21/04 340/908

* cited by examiner

*Primary Examiner* — Jennifer D. Carruth
(74) *Attorney, Agent, or Firm* — Andrew D. Fortney; Central California IP Group, P.C.

(57) ABSTRACT

An amenity, such as a heater or a light fixture is mounted in a frame which is suspended from a swiveling arm attached to an upright. Utilities are conducted to the amenity through the upright, the arm and the frame. The swiveling arm permits easy relocation of the amenity to maximize comfort and utility for users.

20 Claims, 5 Drawing Sheets

SWIVELING SUPPORT FOR AMENITIES

BACKGROUND OF THE INVENTION

1. Field of the Invention

The present invention relates to support structures and, more particularly, a swiveling support for an exterior amenity such as a heater or light fixture.

2. General Background and State of the Art

It has become rather commonplace to entertain in outdoor areas where there is usually a need for lighting and, in temperate areas, heating in the cooler evening hours. Supplemental lighting is generally an easy task as electrical outlets are generally available and light fixtures can be easily placed and, where necessary, relocated. Space heating is not as easy. Portable space heaters have been developed which use a gas flame to heat a metal mesh cylinder which radiates heat. Such heaters include a gas storage device, an igniter and a base, frequently equipped with wheels so that the location of the heater can be changed. The heater unit is elevated to minimize the hazard of contact with the unit and maximize the area to be heated.

A recurring problem with such heaters is that they are not always in the optimum location for diners in restaurants or guests at an outdoor event. In most instances, the heaters need only be moved a few feet for optimum placement, which usually entails the moving of the entire unit. However, some heaters are in more or less permanent locations with connections to utilities such as electric or gas. Portable heaters can be quite heavy if the fuel supply is maintained within the base of the heater. Most portable area heaters have a self contained fuel supply.

It would be desirable if such heating or lighting units could have the benefit of a permanent connection to utilities, such as electricity or gas, and yet be able to be repositioned for those instances when the fixed location is not the best placement for the activities taking place or the comfort of those in the area.

Alternatively, it would be helpful, in those instances where the heater or lighting fixture is entirely self contained and therefore quite heavy and not easily moved, if slight adjustments could be made without the need for relocating the entire unit.

INVENTION SUMMARY

According to the present invention, a support pole can be permanently installed with connections to utilities such as gas and electricity. A swiveling arm is affixed to the top of the pole. A frame depends from the outer end of the arm and a fixture, such as a heater or lighting unit is connected to the frame. The utilities are conducted through the pole, the arm and the frame to the heater or lighting unit. In use, the arm carrying the heater or lighting unit can be easily moved to a location that better suits the needs of the persons seeking warmth or light.

In the event that a non-permanent installation is preferred, a self contained unit with fuel and or batteries can also be modified to include a swiveling arm containing a support frame to house the heater or lighting unit. As with the permanent installation, the fuel or electricity can be routed through the arm and frame to connect with the heater or lighting unit.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF THE PREFERRED EMBODIMENTS

Figure 1:
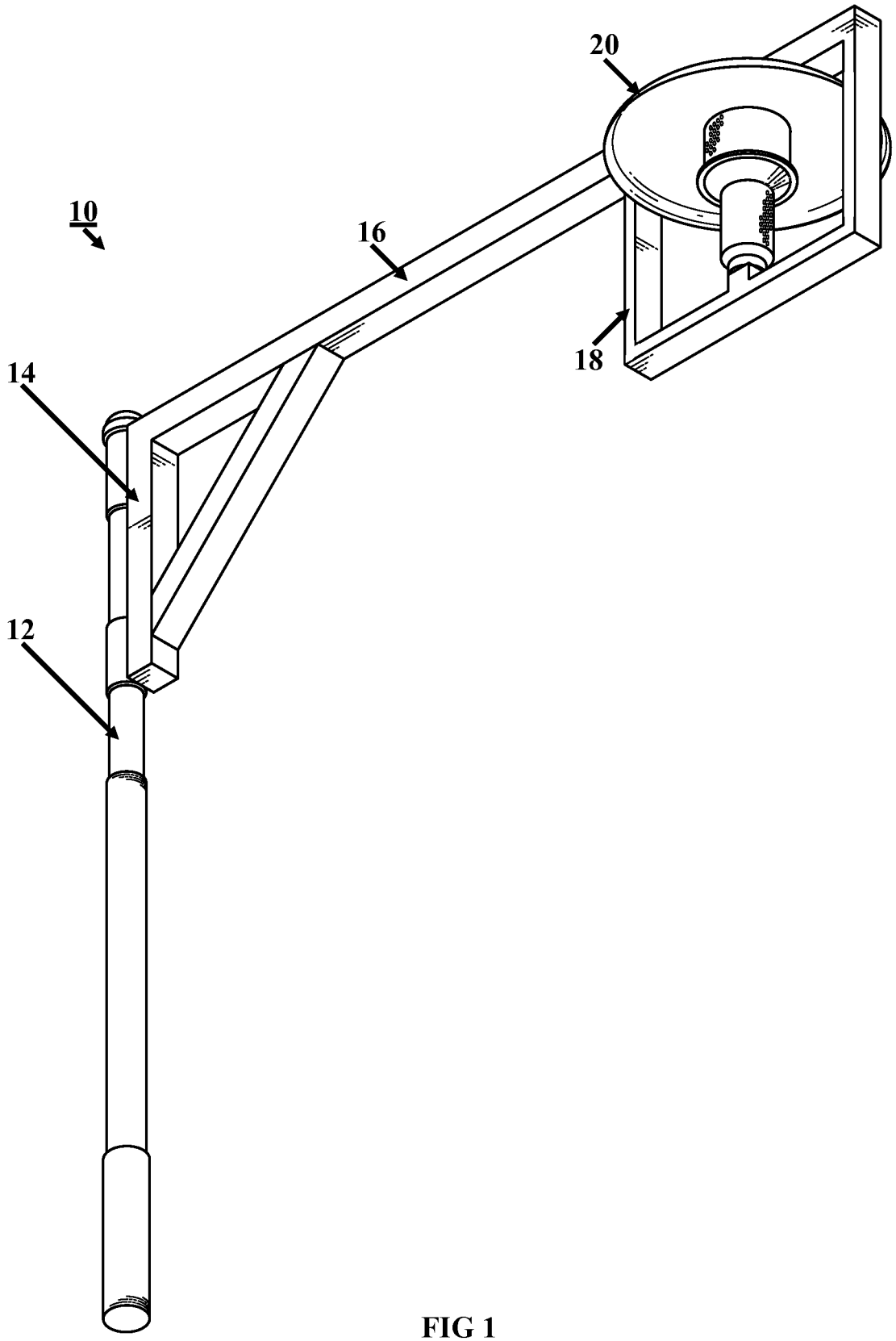
FIG. 1 is a perspective view of the support of the present invention in which a space heater is installed.

Turning first to FIG. 1, there is shown a support 10 according to the present invention. The support 10 is comprised of a vertical pole 12, a swivel connection 14, a horizontal arm 16 and a support frame 18. Mounted within the support frame 18 is an amenity, in this example, a space heater 20.

Figure 2:
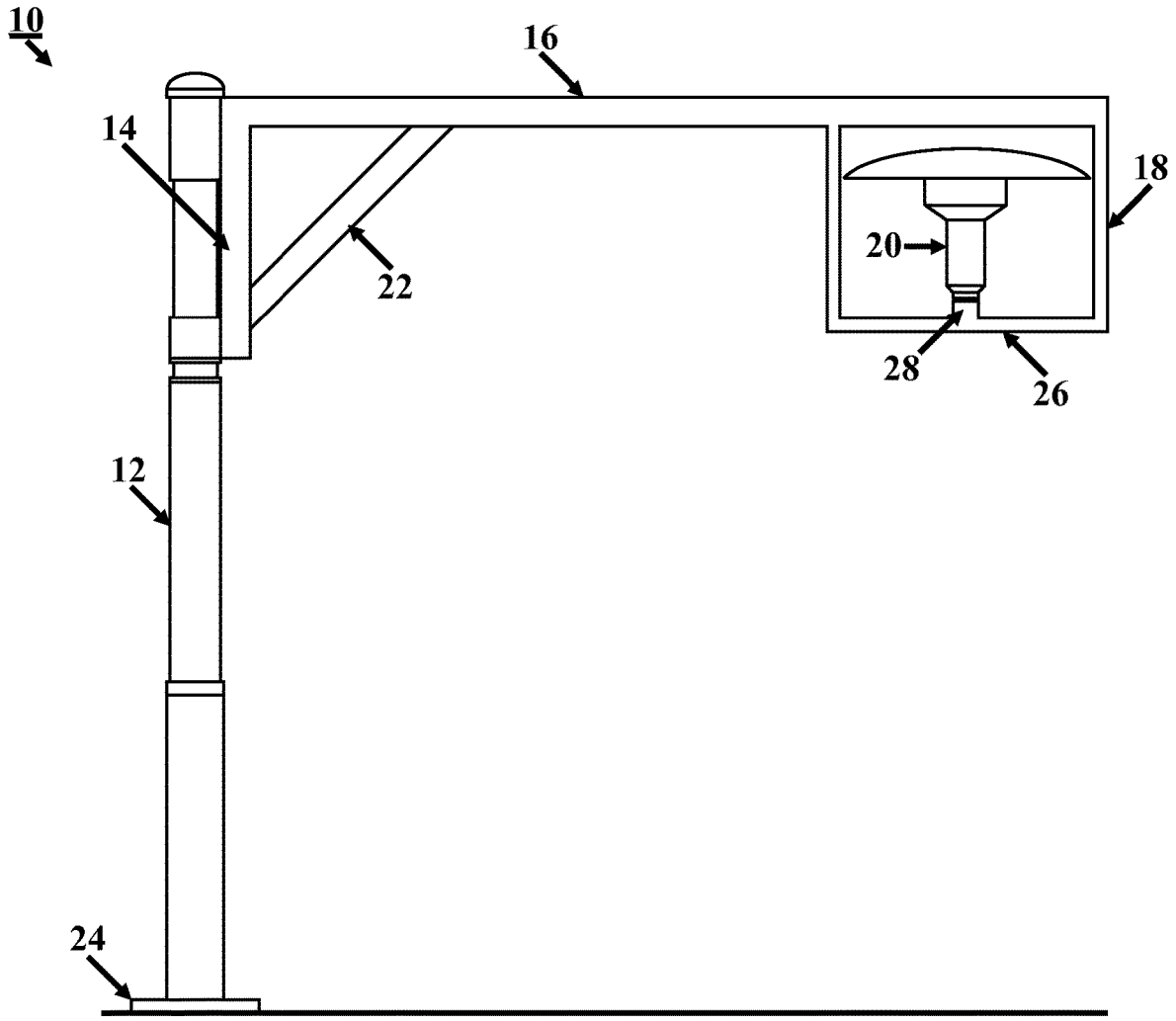
FIG. 2 is a side view of the support of the present invention.

In FIG. 2, the support 10 can be seen in greater detail. A brace member 22 is placed between the vertical pole 12 or the swivel connection 14 and the horizontal arm 16 to support the weight of the horizontal arm 16 and the space heater 20. As is shown, the support frame 18 is a u-shaped structure that depends from the horizontal arm 16. The vertical pole 12 is mounted in a base plate 24 which can be permanently fastened to whatever the support 10 rests upon. Alternatively, a sufficiently wide base could be provided to enable the support 10 to be free standing. It is also possible to supply a base weighted sufficiently to retain the support 10 in an upright orientation notwithstanding forces tending to tip it over.

Centrally located on a horizontal member 26 of the support Frame 18 is a mounting receptacle 28 which receives the space heater 20 and supplies it with utilities such as gas and electricity. As shown in FIG. 2, the horizontal arm 16 carrying the space heater 20 can be rotated about the vertical pole 12 to provide warmth where it is needed, rather than being in a fixed location.

Figure 3:
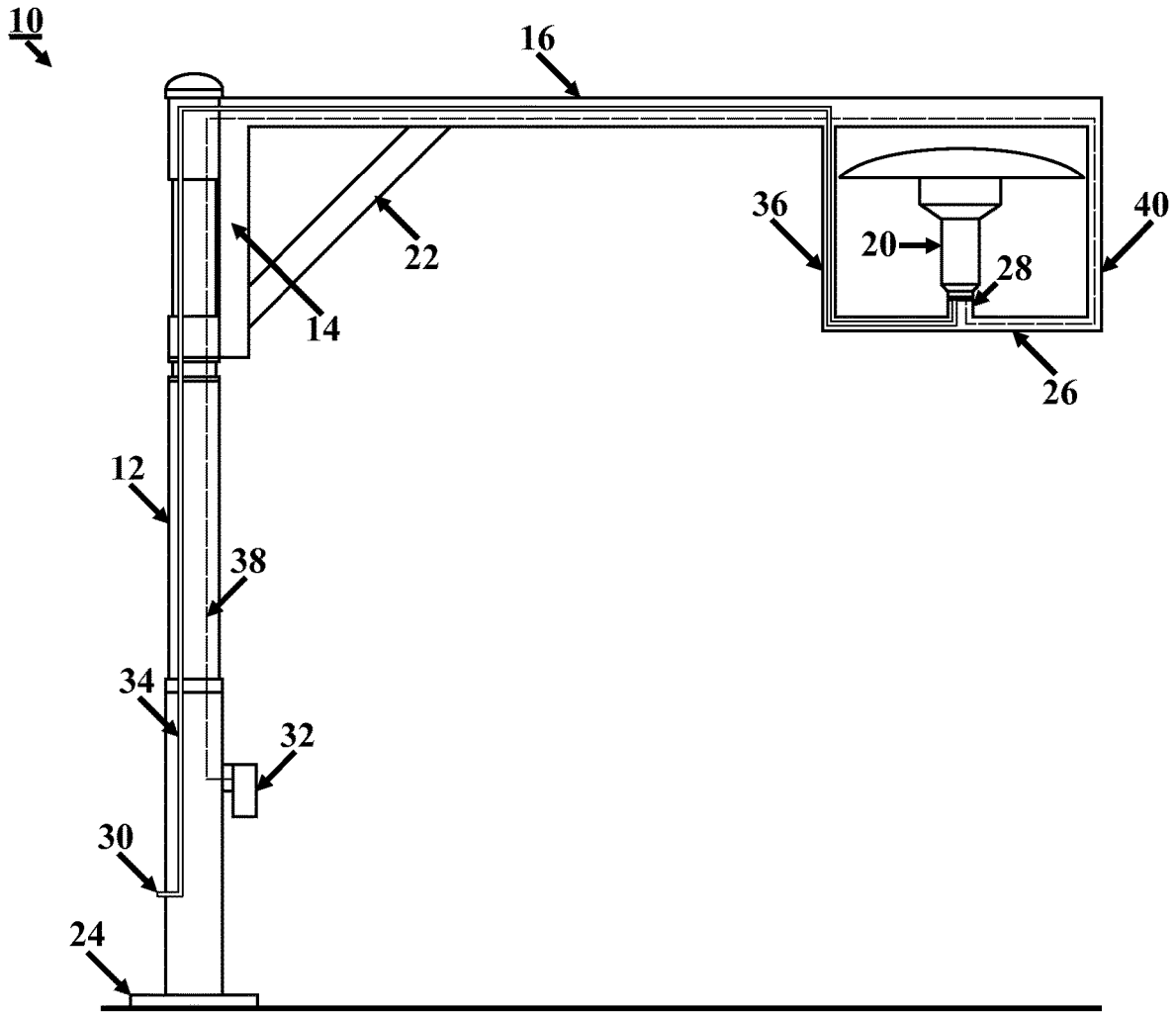
FIG. 3 is a side view of the support of the present invention showing the routing of utilities.

Turning next to FIG. 3, there is shown the support 10. At the base of the vertical pole 12 is a gas inlet 30 which is adapted to be connected to a source of gas which may be a utility or which may be a portable compressed gas tank (not shown) storing compressed natural gas or propane. Also at the base of the vertical pole 12 is an electrical junction box 32 which may include a transformer to convert 110 v. a.c. to a lower voltage such as 24 v. to minimize the hazards of electricity.

A flexible gas conduit 34 is routed through the interior of the vertical pole 12, through the horizontal arm 16 and into a first frame upright 36 and the horizontal member 26 to the mounting receptacle 28. Similarly, low voltage wiring 38 also travels through the interior of the vertical pole 12, through the horizontal arm 16 into a second frame upright 40 and into the opposite end of the horizontal member 26 to the mounting receptacle 28.

Figure 4:
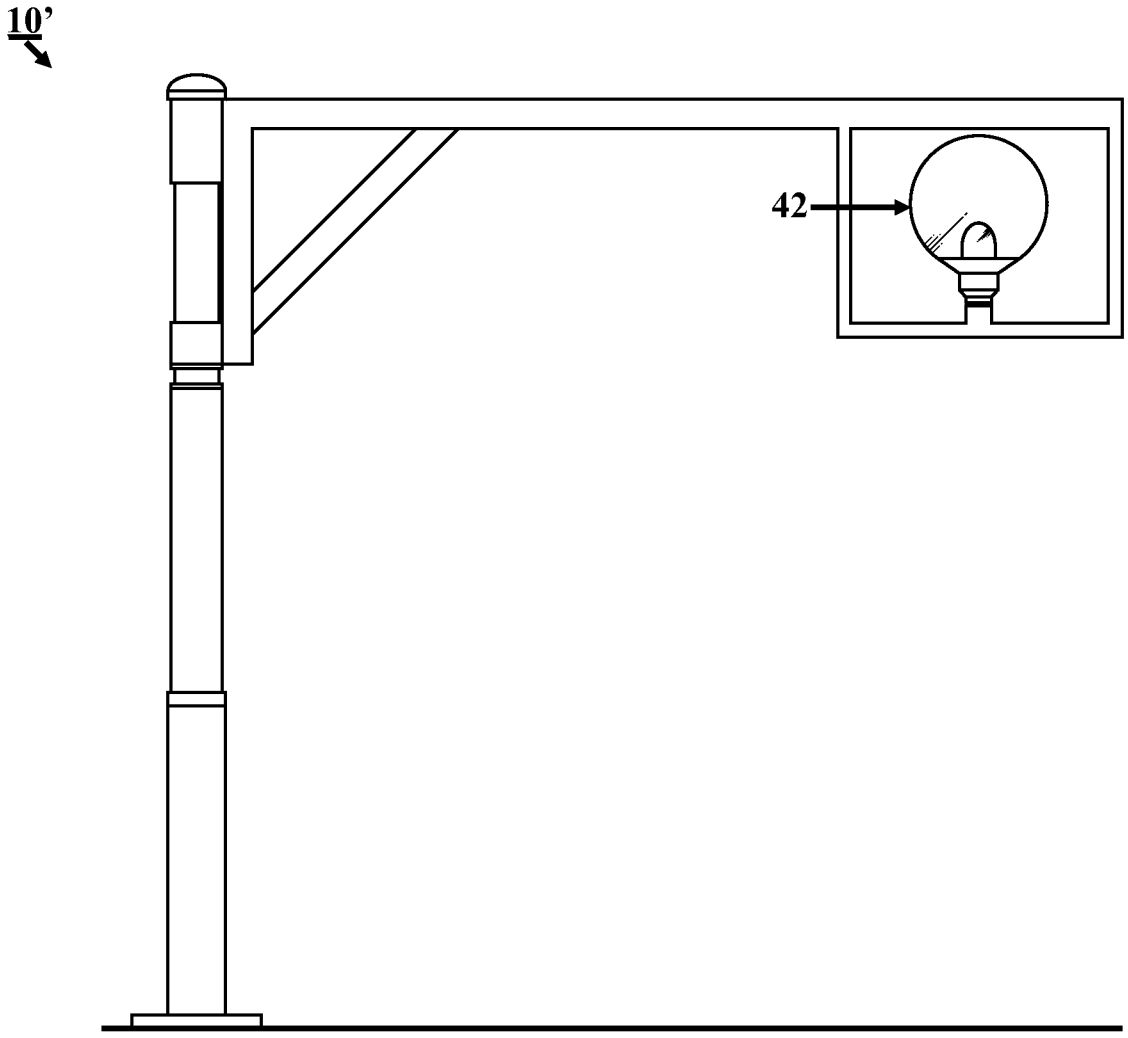
FIG. 4 is a side view of an alternative embodiment in which the amenity is a lighting fixture.

In FIG. 4 there is shown an alternative embodiment 10' of the apparatus of FIGS. 1 and 2 but with a lamp 42 in place of a space heater 20. In this embodiment, the horizontal arm can be moved about the swivel for providing better lighting to the area.

Figure 5:
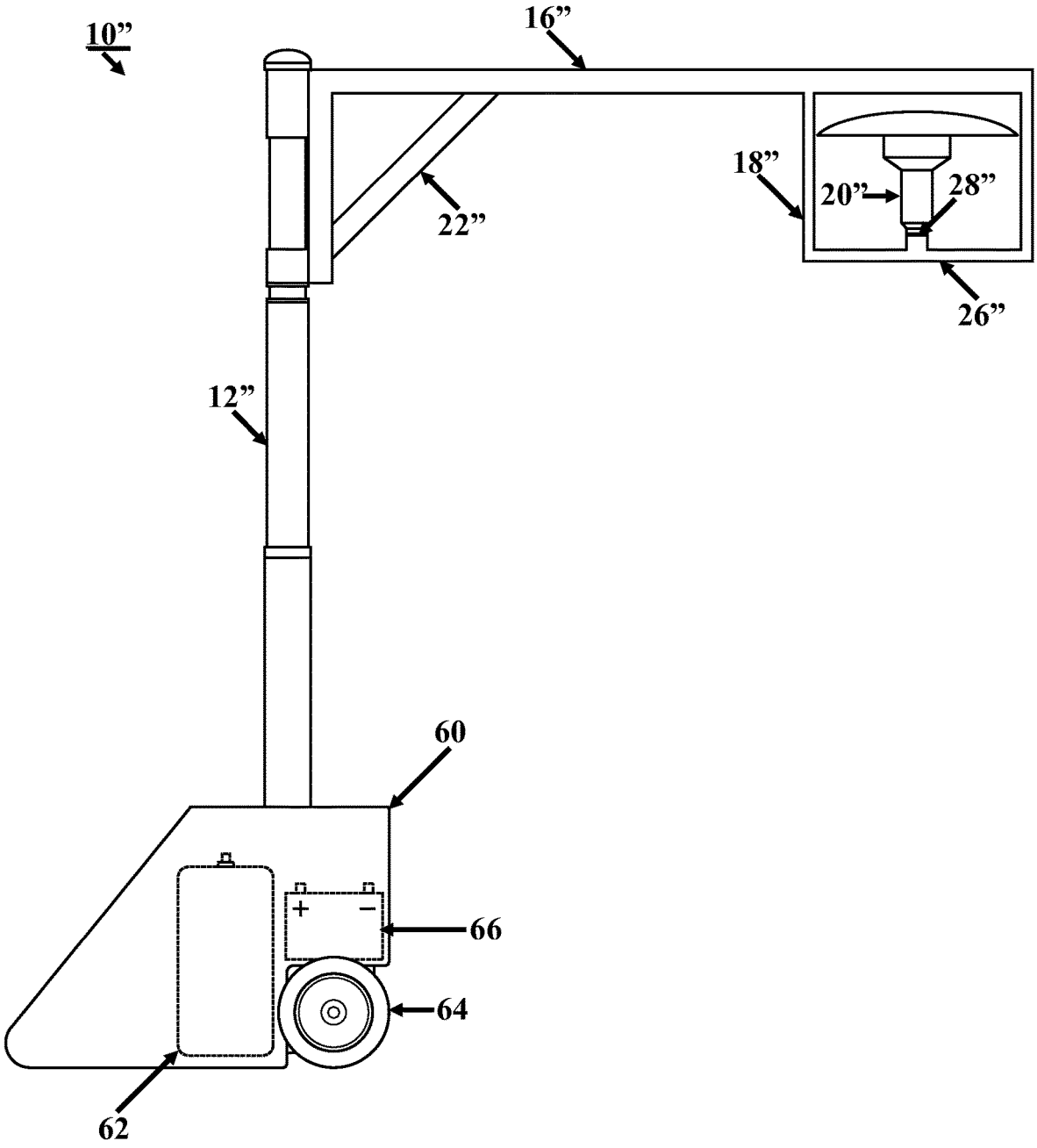
FIG. 5 is a side view of an alternative, portable embodiment of the present invention.

Turning finally to FIG. 5, there is shown an alternative, portable support 10". A brace member 22" is placed between a vertical pole 12" or the swivel connection and a horizontal arm 16" to support the weight of the horizontal arm 16" and an amenity, here a space heater 20". As is shown, the support frame 18" is a u-shaped structure that depends from the horizontal arm 16". The vertical pole 12" is mounted in housing 60 which contains the fuel supply 62 and a battery 66, where needed. The housing 60 should have sufficient weight to retain the support 10" in an upright orientation notwithstanding forces tending to tip it over. A pair of wheels 64 are attached to the housing 60 to aid in moving the entire structure.

Centrally located on a horizontal member 26" of the support frame 18" is a mounting receptacle 28" which receives the space heater 20" and supplies it with fuel and electricity. As in FIG. 2, the horizontal arm 16" carrying the space heater 20" can be rotated about the vertical pole 12" to provide warmth where it is needed, rather than being in a fixed location.

While the specification describes particular embodiments of the present invention, those of ordinary skill can devise variations of the present invention without departing from the inventive concept. Accordingly, the scope of the invention should be limited only by the scope of the claims appended hereto.

What is claimed as new is:

1. Apparatus for supporting an amenity, comprising:

a. a vertical support member having a first interior void;

b. a horizontal support member having a second interior void;

c. a swivel coupling said vertical and horizontal support members and enabling Q communication between said first and second interior voids and (ii) said horizontal support member to rotate horizontally around said vertical support member;

d. an amenity support frame having a third interior void, coupled to said horizontal support member such that said third interior void is in communication with said second interior void;

e. an amenity attachment member in said amenity support frame adapted to receive and an amenity attached to said amenity attachment member; and f. a fuel conduit extending through said first, second and third interior voids to said amenity attachment member for supplying fuel to said amenity, said fuel comprising a gas.

2. The apparatus of claim 1, further including an electrical conduit extending through said first, second and third interior voids to said attachment member for supplying electrical energy to said amenity.

3. The apparatus of claim 2, further including an electrical supply coupled to said electrical conduit for supplying said electrical energy to said electrical conduit.

4. The apparatus of claim 1, further including a fuel supply coupled to said fuel conduit for furnishing said fuel to said fuel conduit.

5. The apparatus of claim 4, wherein the amenity attachment member comprises a mounting receptacle into which the amenity is mounted, and the mounting receptacle supplies the amenity with said fuel and said electrical energy.

6. The apparatus of claim 1, further comprising a brace between the horizontal support member and either the vertical support member or the swivel.

7. The apparatus of claim 6, wherein the swivel comprises one or more rings, collars or cylinders around the vertical support member.

8. The apparatus of claim 1, further comprising a base plate on which the vertical support member is mounted.

9. The apparatus of claim 8, wherein the base plate is permanently fastenable, sufficiently wide to enable the apparatus to be free standing, or weighted sufficiently to retain the apparatus in an upright orientation.

10. Apparatus for supporting an outdoor heater comprising:

a. a vertical support member having a first interior void;

b. a horizontal support member having a second interior void;

c. a swivel coupling said vertical and horizontal support members and enabling Q communication between said first and second interior voids and (ii) said horizontal support member to rotate horizontally around said vertical support member;

d. an outdoor heater attachment member coupled to said horizontal support member, in communication with said second interior void;

e. an outdoor heater attached to said outdoor heater attachment member; and f. a fuel conduit extending through said first and second interior voids to said outdoor heater attachment member for supplying fuel to said outdoor heater, said fuel comprising a gas.

11. The apparatus of claim 10, further including an electrical conduit extending through said first and second interior voids to said attachment member for supplying electrical energy to said outdoor heater.

12. The apparatus of claim 10, further including a fuel supply coupled to said fuel conduit for furnishing said fuel to said fuel conduit.

13. The apparatus of claim 10, further comprising a brace between the horizontal support member and either the vertical support member or the swivel.

14. The apparatus of claim 10, wherein the swivel comprises one or more rings, collars or cylinders around the vertical support member.

15. The apparatus of claim 10, further comprising a base plate on which the vertical support member is mounted.

16. The apparatus of claim 15, wherein the base plate is permanently fastenable, sufficiently wide to enable the apparatus to be free standing, or weighted sufficiently to retain the apparatus in an upright orientation.

17. The apparatus of claim 16, wherein the base plate is sufficiently wide to enable the apparatus to be free standing and weighted sufficiently to retain the apparatus in an upright orientation.

18. The apparatus of claim 10, wherein the outdoor heater attachment member comprises a mounting receptacle into which the outdoor heater is mounted, and the mounting receptacle supplies the amenity with said fuel.

19. Apparatus for supporting a lighting fixture, comprising:

a. a vertical support member having a first interior void;

b. a horizontal support member having a second interior void;

c. a swivel coupling said vertical and horizontal support members and enabling (i) communication between said first and second interior voids and (ii) said horizontal support member to rotate horizontally around said vertical support member;

d. a lighting fixture support frame having a third interior void, coupled to said horizontal support member such that said third interior void is in communication with said second interior void;

e. a lighting fixture attachment member in said lighting fixture support frame and a lighting fixture attached to said lighting fixture attachment member; and f. an electrical conduit extending through said first, second and third interior voids to said attachment member for supplying electrical energy to said lighting fixture.

20. The apparatus of claim 19, further including an electrical supply coupled to said electrical conduit for supplying said electrical energy to said electrical conduit.

* * * * *